US007775291B2

(12) United States Patent
Jacob

(10) Patent No.: US 7,775,291 B2
(45) Date of Patent: Aug. 17, 2010

(54) RETRIEVABLE SURFACE CONTROLLED SUBSURFACE SAFETY VALVE

(75) Inventor: Jean-Luc Jacob, Bellocq (FR)

(73) Assignee: Weatherford/Lamb, Inc., Houston, TX (US)

( * ) Notice: Subject to any disclaimer, the term of this patent is extended or adjusted under 35 U.S.C. 154(b) by 47 days.

(21) Appl. No.: 12/128,790

(22) Filed: May 29, 2008

(65) Prior Publication Data

US 2009/0294135 A1 Dec. 3, 2009

(51) Int. Cl.
*E21B 34/14* (2006.01)

(52) U.S. Cl. ..... 166/386; 166/322; 166/332.5; 166/332.8

(58) Field of Classification Search ..... 166/375, 166/386, 332.5, 332.8, 322
See application file for complete search history.

(56) References Cited

U.S. PATENT DOCUMENTS 3,494,417 A * 2/1970 Fredd ..... 166/73
3,910,352 A 10/1975 Mott
4,691,776 A 9/1987 Pringle
4,836,287 A * 6/1989 Eric et al. ..... 166/321
5,094,294 A 3/1992 Bayh, III
5,305,828 A 4/1994 White et al.
5,358,053 A 10/1994 Akkerman
5,361,834 A 11/1994 Cox
5,865,255 A 2/1999 Hammett et al.
7,040,409 B2 5/2006 Sangla
2004/0045722 A1 3/2004 Sangla

FOREIGN PATENT DOCUMENTS

FR 2734863 A1 12/1996
WO 2006/133351 A2 12/2006

OTHER PUBLICATIONS

"Thru-Tubing Intervention: PB Packer;" Weatherford International Ltd. (c) 2006.
"Thru-Tubing Intervention: GP Gravel-Pack System;" Weatherford International Ltd. (c) 2006.
"Thru-Tubing Packers: ER Packer;" Weatherford International Ltd. (c) 2008.
"Thru-Tubing Packers: WidePak(TM) Packer;" Weatherford International Ltd. (c) 2008.
Combined Examination and Search Report in corresponding UK appl. No. GB0906097.1, dated Aug. 11, 2009.
Combined Examination and Search Report in counterpart UK Appl. No. GB0904319.1, dated Aug. 10, 2009, 3 pgs.

* cited by examiner

*Primary Examiner*—Shane Bomar
(74) *Attorney, Agent, or Firm*—Wong, Cabello, Lutsch, Rutherford & Brucculeri LLP

(57) ABSTRACT

A safety valve apparatus has a housing with a bore and a projection disposed in the bore. A locking dog disposed on the housing is movable to engage an inner conduit wall surrounding the housing, and a flapper rotatably disposed on the housing is movable between opened and closed positions. A first sleeve disposed within the bore above the projection is mechanically movable between locked positions. In one locked position, the sleeve moves the locking dog to engage the wall. A piston disposed in the housing hydraulically communicates with a port in the projection and couples to a second sleeve disposed within the bore below the projection. The second sleeve conceals the piston and is hydraulically movable to open and close the flapper.

36 Claims, 6 Drawing Sheets

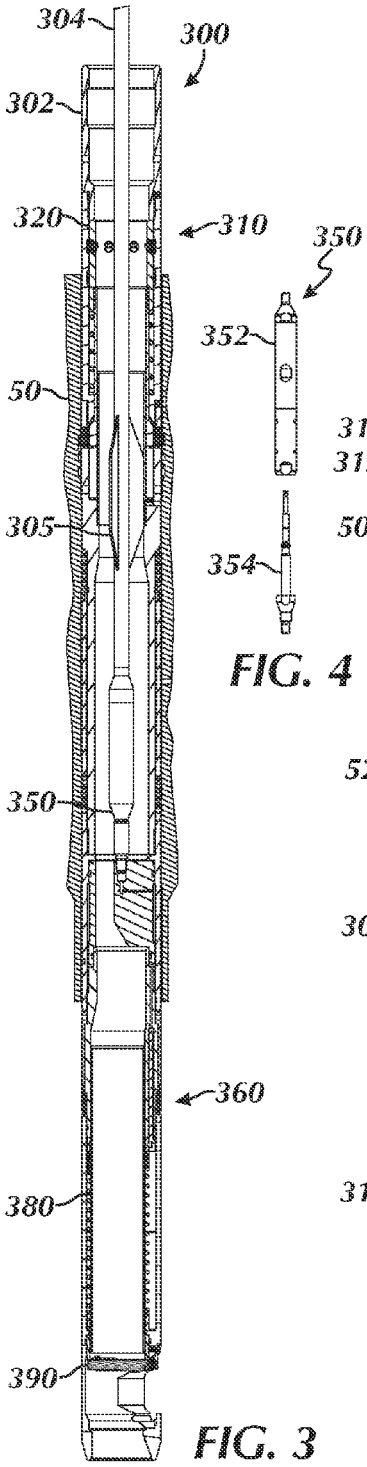
FIG. 3
FIG. 4
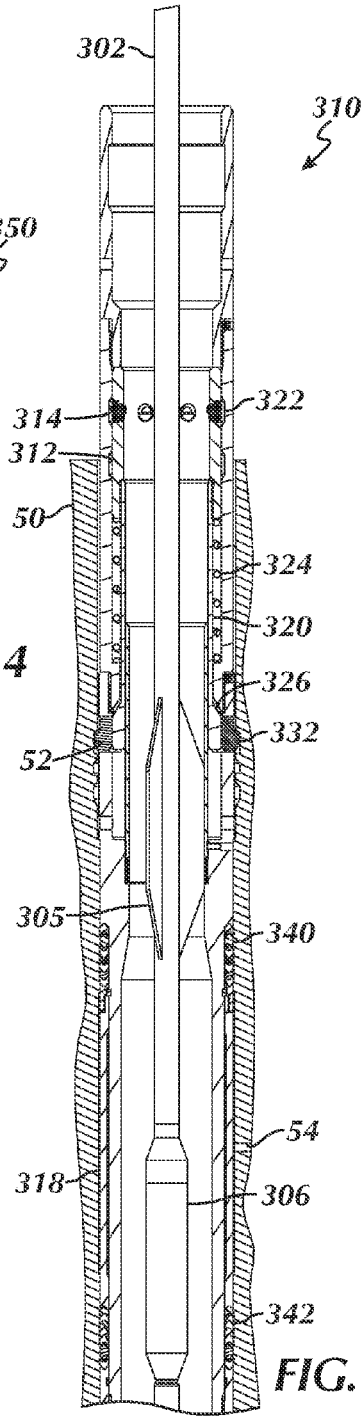
FIG. 5A
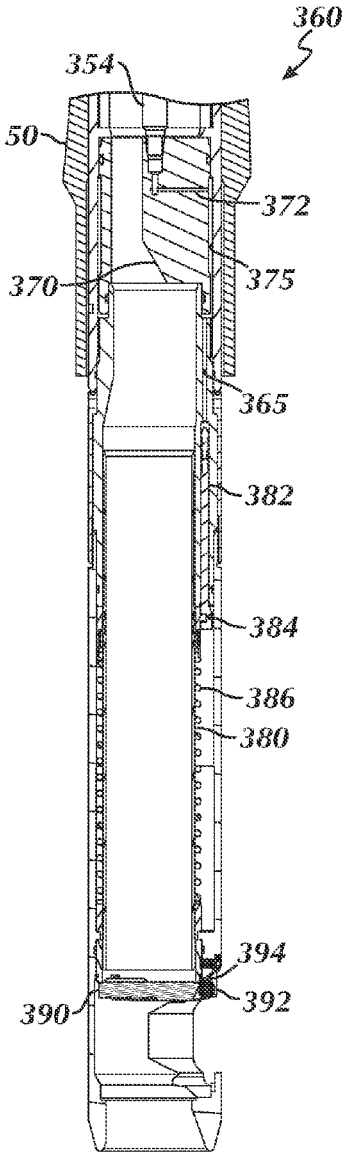
FIG. 5B

RETRIEVABLE SURFACE CONTROLLED SUBSURFACE SAFETY VALVE

CROSS-REFERENCE TO RELATED APPLICATIONS

This application is filed concurrently with U.S. patent application Ser. No. 12/128,811, entitled "Surface Controlled Subsurface Safety Valve with Integral Pack-Off" by Richard Jones, Jean-Luc Jacob, Todd Travis, Brandon Cain, Eric Calzoncinth, & Paul Perez, which is incorporated herein by reference in its entirety.

BACKGROUND

When an existing safety valve in a well becomes inoperable, operators must take measures to rectify the problem by either working over the well to install an entirely new safety valve on the tubing or deploying a safety valve within the existing tubing. In the past, operators may have simply deployed a subsurface controlled subsurface safety valve in the well. The subsurface controlled valves could be a velocity valve or Protected Bellows (PB) pressure actuated valve. However, regulatory requirements and concerns over potential blowout have prompted operators to work over the well rather than deploying such subsurface controlled valves. As expected, working over a well can be time consuming and expensive. Therefore, operators would prefer to deploy a surface controlled safety valve in the tubing of the well without having to work over the well.

Current technology primarily allows surface controlled safety valves to be deployed in wells that have either an existing tubing-mounted safety valve or a tubing-mounted safety valve landing nipple. In French Patent No. FR 2734863 to Jacob Jean-Luc, for example, a surface controlled safety valve device 100 is disclosed that can be landed in an existing landing nipple from which the original safety valve has been removed. This safety valve device 100 reproduced in FIGS. 1A-1B is set in the landing nipple 10 using a special adapter 160 that mechanically hold the locking dogs 102 and the flapper 104 of the device 100 until the device 200 can be properly positioned in the landing nipple 10. Then, when releasing the device 100, the adapter 160 must disengage from the device 100 so that the locking dogs 102 engage the nipple 10 while simultaneously letting the flapper 104 close. Moreover, these steps must be performed while not damaging a hydraulic connector 120 and intermediate tubing 130 exposed in the device 100 adjacent to where the special adapter 160 holds the device 200.

When deployed in the landing nipple 10, a conduit (not shown) communicated through the tubing connects to the device 100 to operate the flapper 104. This conduit conveys hydraulic fluid to the connector 120 connected to a fixed portion 123 in the device 100. This fixed portion 123 in turn communicates the fluid to the intermediate tubing 130 that is movable in the fixed portion 123. A cross port 132 from the intermediate tubing 130 communicates the fluid so that it fills a space 133 and moves a sleeve 134 connected to the intermediate tubing 130. As the sleeve 134 moves down against the bias of a spring, it opens the flapper 104. Because the mechanisms for operating the device 100 are exposed and involve several moving components, the mechanical operation of this device 100 is less than favorable. Moreover, the exposed mechanisms that operate the device 100 with their several moving parts can become damaged.

In U.S. Pat. No. 7,040,409 to Sangla, another safety valve device for wells is disclosed that can be deployed in tubing without the need for an existing landing nipple. This device 200 is reproduced in FIGS. 2A-2B. As shown in FIG. 2B, the lower part of the device 200 has a flapper 210 that closes by a spring (not shown) and opens by a sleeve 212 under the thrust action of a ring 214 connected to a piston 216. With sufficient hydraulic pressure in a valve opening chamber 218, the piston 216 and ring 214 press the sleeve 212 against the bias of the spring 213 so that the sleeve 212 slides down and opens the flapper 210. With the flapper 210 open, a passage 202 in the device 200 permits fluid communication through the device 200. In the absence of pressure in the chamber 218, the spring 213 pushes the sleeve 212 upwards so that the flapper 210 closes.

To position the device 200 in tubing 20, the lower part of the device 200 as shown in FIG. 2B has lower anchor dogs 220*a*. These lower dogs 220*a* are displaced radially by a lower piston 222*a* whose end has the shape of a cone on which the lower dogs 220*a* rest. The lower piston 222*a* is pushed under the lower dogs 220*a* by the hydraulic pressure in a lower anchor chamber 224*a* so that the displacement of the lower piston 222*a* locks the lower dogs 220*a* on the wall of tubing 20. Locks 226*a*, such as dog stops or teeth, hold the lower piston 222*a* in place even when the pressure has dropped in lower chamber 224*a*. The upper part of the device 200 as shown in FIG. 2A similarly has upper anchor dogs 220*b*, piston 222*b*, hydraulic chamber 224*b*, and locks 226*b*.

To create a seal in the tubing 20, the device 200 uses a pile of eight cups 230 that position between the device 200 and the tubing 20. These cups 230 have a general herringbone U or V shape and are symmetrically arranged along the device's central axis. Hydraulic pressure present in a sealing assembly chamber 234 displaces a piston 232 that activates the cups 230 against the tubing 20. Locks 236 hold this piston 232 in place even without pressure in the chamber 234.

Hydraulic pressure communicated from the surface operates the device 200. In particular, rods (not shown) from the surface connect to a connector 240 that communicates with internal line 242. This internal line 242 communicates with an interconnecting tube 250 to distribute hydraulic pressure to the valve opening chamber 234 via a cross port 243, to the anchor chamber 224*a-b* via cross ports 244*a-b*, and to the sealing assembly chamber 218 via the tube 250. A hydraulic pressure rise in line 242 transmits the pressure to all these chambers simultaneously. When the hydraulic pressure drops in line 242, the device 200 closes but remains in position, anchored and sealed. A special profile 204 arranged at the top of the device 200 can be used to unanchor the device 200 by traction and jarring with a fishing tool suited to this profile 202. By jarring on the device 200, a series of shear pins are broken, thus releasing anchor pistons 222*a-b* and the sealing piston 232. The released device 200 can then be pulled up to the surface.

As with the valve 100 of FIGS. 1A-1B, the valve 200 of FIGS. 2A-2B also has features that are less than ideal. First, the pile of cups 230 offers less than desirable performance to hold the device 200 in tubing 20. In addition, the intricate arrangement and number of components including line 242; cross ports 243 and 244*a-b*; tube 250; multiple chambers 218, 224*a-b*, and 234; multiple pistons 216, 222*a-b*, and 232; and exposed rod 216 make the device 200 prone to potential damage and malfunction and further make manufacture and assembly of the device 200 difficult and costly.

Accordingly, a need exists for more effective subsurface safety valves that can be deployed in a well.

BRIEF DESCRIPTION OF THE DRAWINGS

FIG. 3 illustrates a cross-section of a retrievable surface controlled subsurface safety valve according to one embodiment of the present disclosure.

FIG. 4 illustrates an example of male and female members of a preferred quick connector for use with the disclosed valves.

FIG. 5A illustrates a detailed cross-section of an upper portion of the valve in FIG. 3.

FIG. 5B illustrates a detailed cross-section of a lower portion of the valve in FIG. 3.

DETAILED DESCRIPTION

Figure 1A:
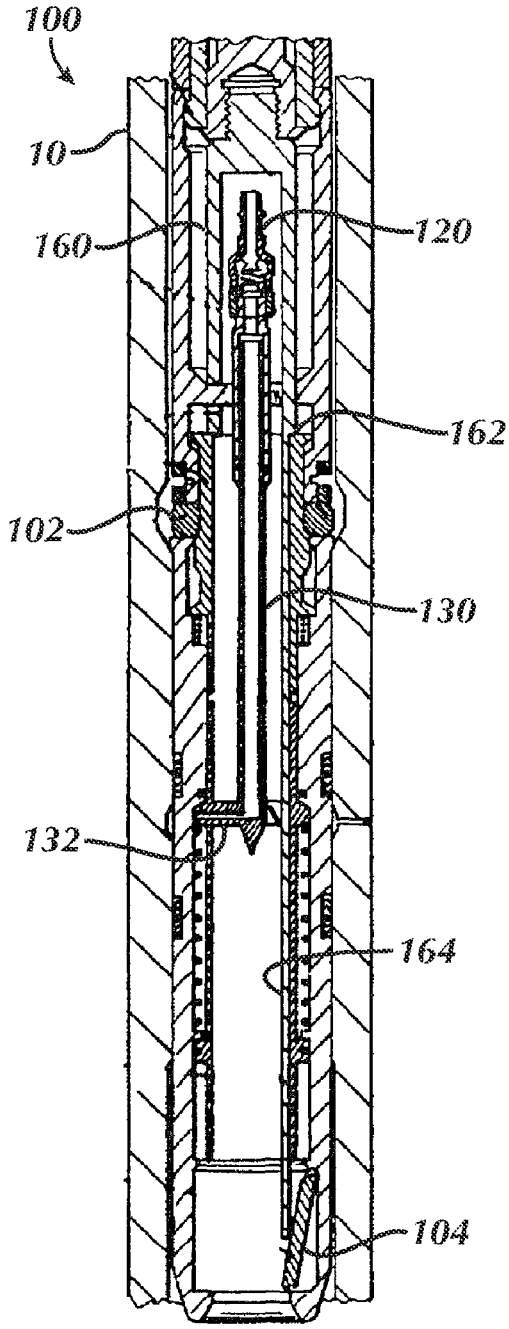
FIG. 1A (Prior Art)
FIGS. 1A-1B illustrate a surface controlled subsurface safety valve according to the prior art.
Figure 1B:
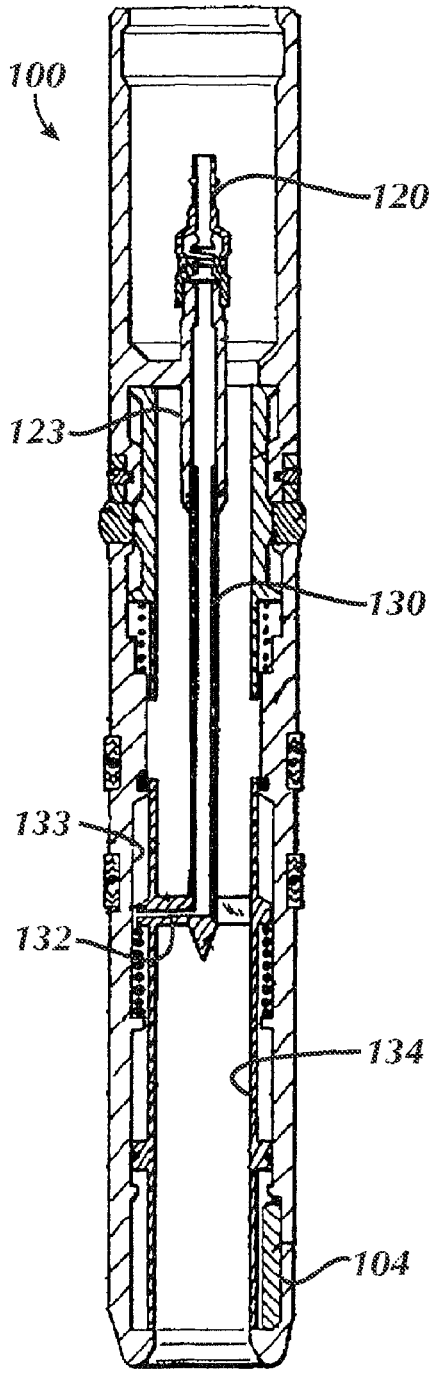
FIG. 1B (Prior Art)
Figure 2A:
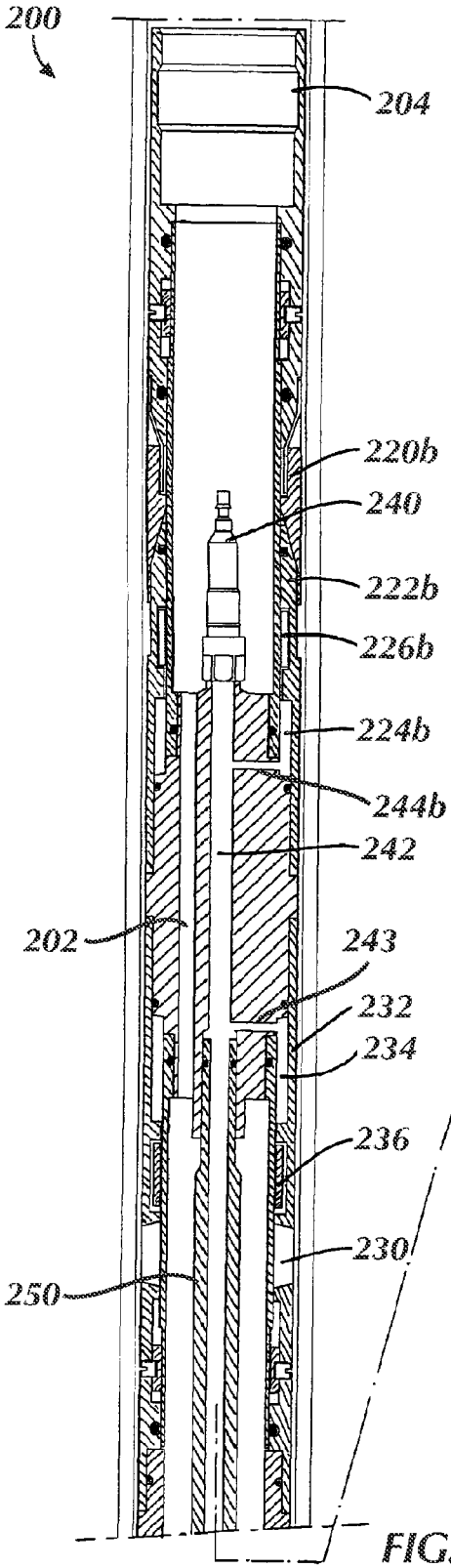
FIG. 2A (Prior Art)
FIGS. 2A-2B illustrate another surface controlled subsurface safety valve according to the prior art.
Figure 2B:
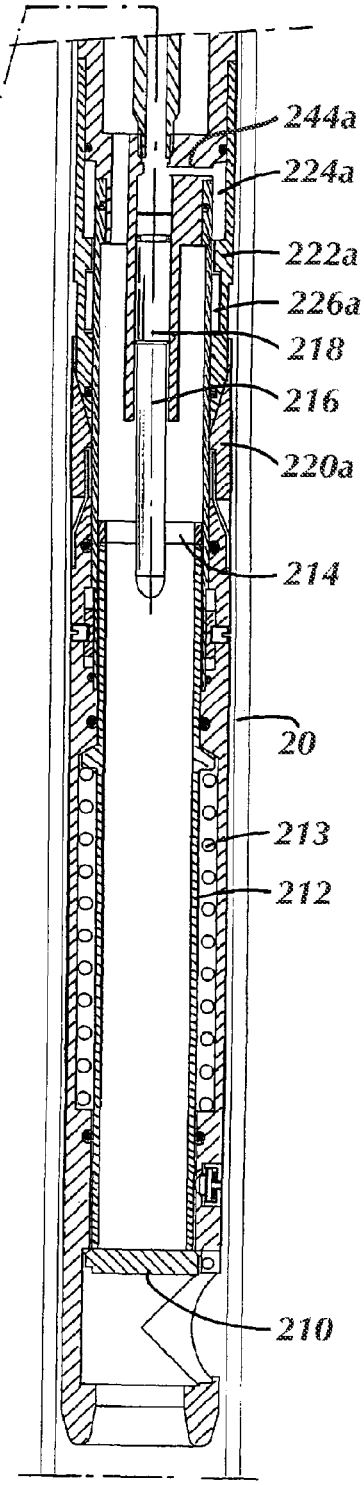
FIG. 2B (Prior Art)

As disclosed herein, a surface controlled subsurface safety valve apparatus can be installed in a well that either has or does not have existing hardware for a surface controlled valve. Coil tubing communicates the hydraulic fluid to the apparatus to operate the valve. One disclosed valve apparatus deploys in a well that has an existing safety valve nipple and is retrievable therefrom. Another disclosed valve apparatus deploys in tubing of a well with or without a safety valve nipple.

I. Retrievable Surface Controlled Subsurface Safety Valve

A retrievable surface controlled subsurface safety valve 300 illustrated in FIG. 3 installs in a well having existing hardware for a surface controlled valve and can be deployed in the well using standard wireline procedures. When run in the well, the valve 300 lands in the existing landing nipple 50 after the inoperable safety valve has been removed.

The safety valve 300 has a housing 302 with a landing portion 310 and a safety valve portion 360. The landing portion 310 best shown in FIG. 5A has locking dogs 332 movable on the housing 302 between engaged and disengaged positions. In the engaged position, for example, the locking dogs 332 engage a groove 52 in the surrounding landing nipple 50 to hold the valve 300 in the nipple 50. The valve portion 360 best shown in FIG. 5B has a flapper 390 rotatably disposed on the housing 302. The flapper 390 rotates on a pivot pin 392, and a torsion spring 394 biases the flapper 390 to a closed position.

To operate the landing portion 310, an upper sleeve 320 shown in FIG. 5A movably disposed within the housing 302 can be mechanically moved between upper and lower locked positions against the bias of a spring 324. In the upper locked position as shown in FIG. 5A, the upper sleeve 320's distal end 326 moves the locking dogs 332 to the engaged position so that they engage the landing nipple's groove 52. Although not shown, the upper sleeve 320 can be mechanically moved to a lower position that permits the locking dogs 332 to move to the disengaged position free from the groove 52.

To operate the valve portion 360, a lower sleeve 380 shown in FIG. 5B movably disposed within the housing 302 can be hydraulically moved from an upper position to a lower position against the bias of a spring 386. When hydraulically moved to the lower position (not shown), the sleeve 380 moves the flapper 390 open. In the absence of sufficient hydraulic pressure, however, the bias of the spring 386 moves the sleeve 380 to the upper position shown in FIG. 5B, permitting the flapper 390 to close by its own torsion spring 394 about its pivot pin 392.

With a basic understanding of the operation of the valve 300, discussion now turns to a more detailed discussion of its components and operation.

A. Deploying the Valve

In deploying the valve 300, a conventional wireline tool (not shown) couples to the profile in the upper end of the valve's housing 302 and lowers the valve 300 to the landing nipple 50. While it is run downhole, trigger dogs 322 on the upper sleeve 320 remain engaged in lower grooves 312 in the housing 302, while the upper sleeve 320 allows the locking dogs 332 to remain disengaged. When in position, the tool actuates the landing portion 310 by moving the upper sleeve 320 upward against the bias of spring 324 and disengaging the trigger dogs 322 from the lower grooves 312 so they engage upper grooves 314. With the upward movement of the sleeve 320, the sleeve's distal end 326 pushes out the locking dogs 332 from the housing 302 so that they engage the landing nipple's groove 52 as shown in FIG. 5A. Once landed, upper and lower chevrons 340/342 on the housing 302 also seal above and below the existing port 54 in the landing nipple 50 provided for the removed valve.

B. Operating the Flapper on the Valve

With the valve 300 landed in the nipple 50, operators lower a capillary string 304 down hole to the valve. This capillary string 304 can be hung from a capillary hanger (not shown) at the surface. The capillary string 304 may include blade centralizers 305 to facilitate lowering the string 304 downhole. The string 304's distal end passes into the valve's housing 302, and a hydraulic connector 350 is used to couple the string 304 to the valve 300. In particular, a female member 352 of the hydraulic connector 350 on the distal end mates with a male member 354 on the valve 300.

Briefly, FIG. 4 shows one example of a connector 350 that can be used with the valves of the present disclosure. The connector 350 can be an automatic connector from Staubli of France. The male member 354 can have part no. N01219806, and the female member 352 can have part no. N01219906. The connector 350 can an exterior pressure rating of about 350 Bar, an interior pressure rating of 550 Bar when coupled, a coupling force of 25 Kg, and a decoupling force of 200 Kg.

Once the members 352/354 are connected as shown, the capillary string 304 communicates with an internal port 372 defined in a projection 370 within the valve 300 as shown in FIG. 5B. Operators then inject pressurized hydraulic fluid through the capillary string 304. As the fluid reaches the internal port 372, it fills the annular space 375 surrounding the projection 370.

From the annular space 375, the fluid reaches a passage 365 in the valve portion 360 and engages an internal piston 382. Hydraulic pressure communicated by the fluid moves this piston 382 downward against the bias of a spring 386 at the piston's end 384. The downward moving end 384 moves the inner sleeve 380 connected thereto so that the inner sleeve 380 forces open the flapper 390. In this way, the valve portion 360 can operate in a conventional manner. As long as hydraulic pressure is supplied to the piston 382 via the capillary string 304, for example, the inner sleeve 380 maintains the flapper 390 open, thereby permitting fluid communication through the valve's housing 302. When hydraulic pressure is released due to an unexpected up flow or the like, the spring 386 moves the inner sleeve 380 away from the flapper 390, and the flapper 390 is biased shut by its torsion spring 394, thereby sealing fluid communication through the valve's housing 302.

C. Retrieving the Valve

Retrieval of the valve 300 can be accomplished by uncoupling the hydraulic connector 350 and removing the capillary string 304. Then, a conventional wireline tool can engage the profile in valve's upper end, disengage the locking dogs 332 from the nipple's slot 52, and pull the valve 300 up hole.

D. Advantages

As opposed to prior art subsurface controlled safety valves, the disclosed valve 300 has a number of advantages, some of which are highlighted here. In one advantage, the valve 300 deploys in a way that lessens potential damage to the valve's components, such as the male member 354 and movable components. In addition, communication of hydraulic fluid to the safety valve portion 360 is achieved using an intermediate projection 370 and a single port 372 communicating with an annular space 375 and piston 382 without significantly obstructing the flow passage through the valve 300. Furthermore, operation of the valve portion 360 does not involve a number of movable components exposed within the flow passage of the valve 300, thereby reducing potential damage to the valve portion 360.

II. Subsurface Safety Valve with Integral Pack Off

The previous embodiment of safety valve 300 lands into an existing landing nipple 50 downhole. By contrast, a surface controlled subsurface safety valve 400 in FIG. 6 installs in a well that does not necessarily have existing hardware for a surface controlled valve. Here, the valve 400 has a hydraulically-set packer/pack-off portion 410 and a safety valve portion 460 that are both set simultaneously using hydraulic pressure from a safety valve control line.

For the pack-off portion 410, the valve 400 has a packing element 420 and slips 430 disposed thereon. The packing element 420 is compressible from an uncompressed condition to a compressed condition in which the element 420 engages an inner wall of a surrounding conduit (not shown), such as tubing or the like. The slips 430 are movable radially from the housing 402 from disengaged to engaged positions in which they contact the surrounding inner conduit wall. The slips 430 can be retained by a central portion (not shown) of a cover 431 over the slips 430 and may be biased by springs, rings or the like.

For the valve portion 460, the valve 400 has a flapper 490 rotatably disposed on the housing 402 by a pivot pin 492 and biased by a torsion spring 494 to a closed position. The flapper 3490 can move relative to the valve's internal bore between opened and closed positions to either permit fluid communication through the valve's bore 403 or not.

Figure 7A:
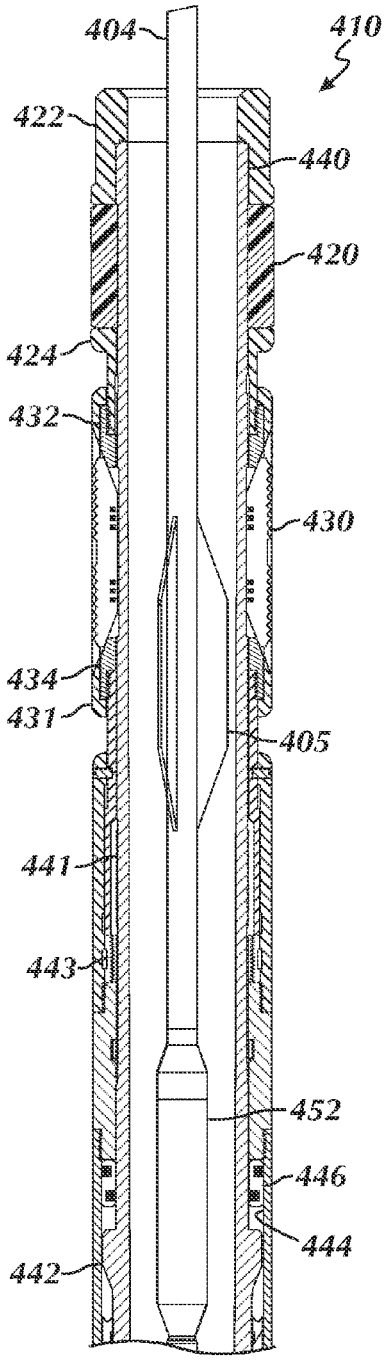
FIG. 7A illustrates a detailed cross-section of an upper portion of the valve in FIG. 6.

To operate the packer portion 410, hydraulic fluid moves an upper sleeve 440 moves within the housing's bore. In one position as shown in FIG. 7A, for example, the upper sleeve 440 leaves the packing element 420 in the uncompressed condition. However, when the upper sleeve 440 is hydraulically moved to a lower position, the sleeve 440's movement compresses the packing element 420 into a compressed condition so as to engage the inner conduit wall.

Figure 7B:
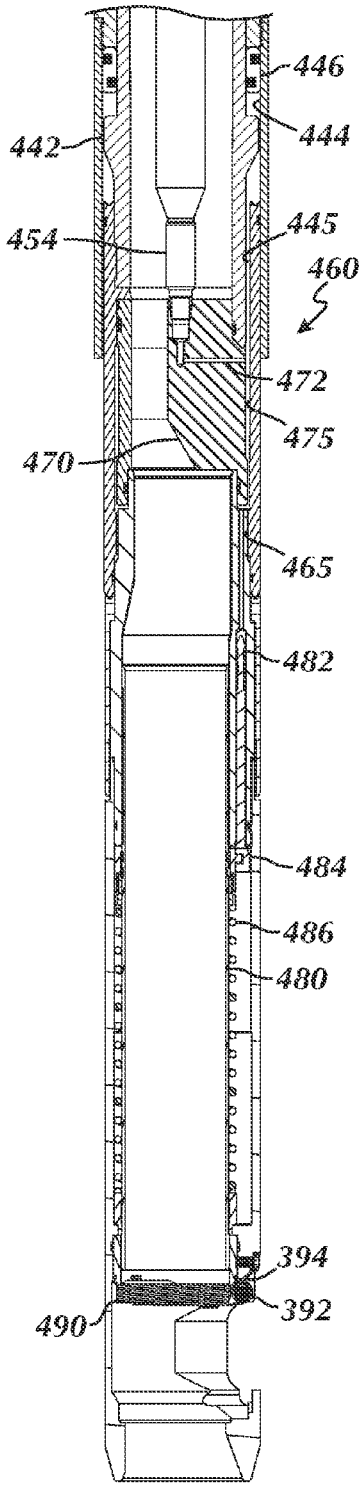
FIG. 7B illustrates a detailed cross-section of a lower portion of the valve in FIG. 6.

To operate the valve portion 460, a lower sleeve 480 shown in FIG. 7B movably disposed within the housing 402 can be hydraulically moved from an upper position to a lower position against the bias of a spring 486. When hydraulically moved to the lower position (not shown), the sleeve 480 moves the flapper 490 open. In the absence of sufficient hydraulic pressure, the bias of the spring 486 moves the sleeve 480 to the upper position, permitting the flapper 490 to close.

With a basic understanding of the operation of the valve 400, discussion now turns to a more detailed discussion of its components and operation.

A. Deploying the Valve

The valve 400 is run in the well using capillary string technology. For example, a capillary string 404 connects inside the valve housing 400 with a hydraulic connector 450 having both a male member 454 and female member 452 similar to that disclosed in FIG. 3. The valve 400 is then lowered by the capillary string 404 to a desired position downhole, and the string 404 is hung from a capillary hanger (not shown) at the surface. The capillary hanger preferably installs in a wellhead adapter at the wellhead tree. The hanger preferably locks into the gap between the flange of the hanger bowl and the flange of the tree supported above. The hanger seals in the body of the tree using self-energizing packing and is accessed by drilling and tapping the tree.

Once positioned, both the packer portion 410 and the safety valve portion 460 are hydraulically set by control line pressure communicated via the capillary string 404. In particular, the capillary string 404 communicates with the sleeve's internal port 472 defined in a projection 470 positioned internally in the housing 402. Operators then inject pressurized hydraulic fluid through the capillary string 404. When the fluid reaches the internal port 472 as shown in FIG. 7B, it fills the annular space 475 surrounding the projection 470.

From the intermediate annular space 475, the fluid communicates via an upper passage 445 to an upper annular space 444 near the upper sliding sleeve 440. As discussed below, fluid communicated via this passage 445 operate the valve's packer portion 410. From the intermediate annular space 475, the fluid also communicates via a lower passage 465 in the valve portion 460 and engages a piston 480. As discussed below, fluid communicated via this passage 465 operates the valve portion 460.

B. Hydraulically Operating the Pack Off

In operating the valve's packer portion 410, the fluid communicated by upper passage 445 fills the upper annular space 444 which is best shown in FIG. 7B. Trapped by sealing member 446, the fluid increase the size of the space 444 and pushes against the sleeve 440's surrounding rib 442, thereby forcing the sleeve 440 downward. As the sleeve 440 moves downward, it moves an upper member 422 connected at the sleeve 440's upper end toward a lower member 424 disposed about the sleeve 440. These members 422/424 compress the packer element 420 between them so that it becomes distended and engages an inner conduit wall (not shown) surrounding it. As preferred, this packing element 420 is a solid body of elastomeric material to create a fluid tight seal between the housing and the surrounding conduit.

As the sleeve 440 moves downward, it moves not only upper and lower members 422/424 but also moves an upper wedged member 432 toward a lower wedged member 434 fixed to lower housing members 440 and 442. As the sleeve 440 moves downward, therefore, the wedged members 432/434 push the slips 430 outward from the housing 402 to engage the inner conduit wall (not shown) surrounding the housing 302. Eventually, as the sleeve 440 is moved downward, outer serrations or grooves 441 on the sleeve 440 engage locking rings 443 positioned in the housing 402 to prevent the sleeve 440 from moving upward.

C. Hydraulically Operating the Flapper

Simultaneously, the communicated hydraulic fluid operates the safety valve portion 460. Here, hydraulic pressure communicated by the fluid via passage 465 moves the piston 482 downward against the bias of spring 486. The downward moving piston 482 also moves the inner sleeve 480, which in turn forces open the rotatable flapper 490 about its pin 392. In this way, the valve portion 460 can operate in a conventional manner. When hydraulic pressure is released due to an unexpected up flow or the like, the spring 486 moves the inner sleeve 484 away from the flapper 490, and the flapper 490 is biased shut by its torsion spring 494.

D. Retrieving the Valve

Retrieval of the safety valve 400 can use the capillary string 404. Alternatively, retrieval can involve releasing the capillary string 404 and using standard wireline procedures to pull the safety valve 400 from the well in a manner similar to that used in removing a downhole packer.

E. Advantages

As opposed to the prior art surface controlled subsurface safety valves, the disclosed valve 400 has a number of advantages, some of which are highlighted here. In one advantage, the valve 400 uses a solid packing element and slip combination to produce the pack-off in the tubing. This produces a more superior seal than found in the prior art which uses a pile of packing cups. Second, the flapper 490 of the valve 400 is operated using an annular rod piston arrangement with the components concealed from the internal bore of the valve 400. This produces a more reliable mechanical arrangement than that found in the prior art where rod, piston, and tubing connections are exposed within the internal bore of the prior art valve. Third, the packing element 420 and the rod piston 482 in the valve are actuated via hydraulic fluid from one port 472 communicating with the coil tubing 404. This produces a simpler, more efficient communication of the hydraulic fluid as opposed to the multiple cross ports and chambers used in the prior art.

Finally, the disclosed valve 400 can be deployed using a capillary string or coil tubing ranging in size from 0.25" to 1.5" and can be retrieved by either the capillary string or by standard wireline procedures. Deploying the valve 400 (as well as valve 300 of FIG. 3) can use a capillary hanger that installs in a wellhead adapter at the wellhead tree and that locks into the gap between the flange of the hanger bowl and the flange of the tree supported above. This capillary hanger preferably seals in the body of the tree using self-energizing packing and is accessed by drilling and tapping the tree.

Figure 6:
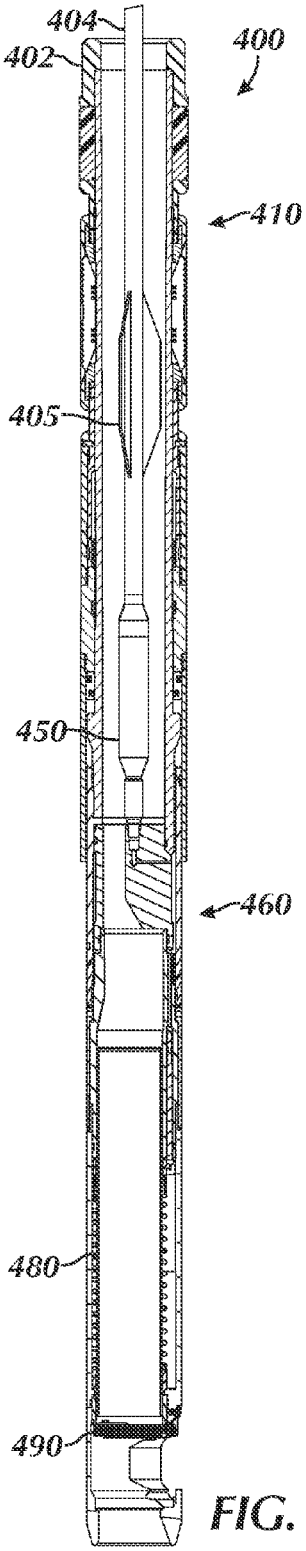
FIG. 6 illustrates a cross-section of a retrievable surface controlled subsurface safety valve according to another embodiment of the present disclosure.
Figure 8A:
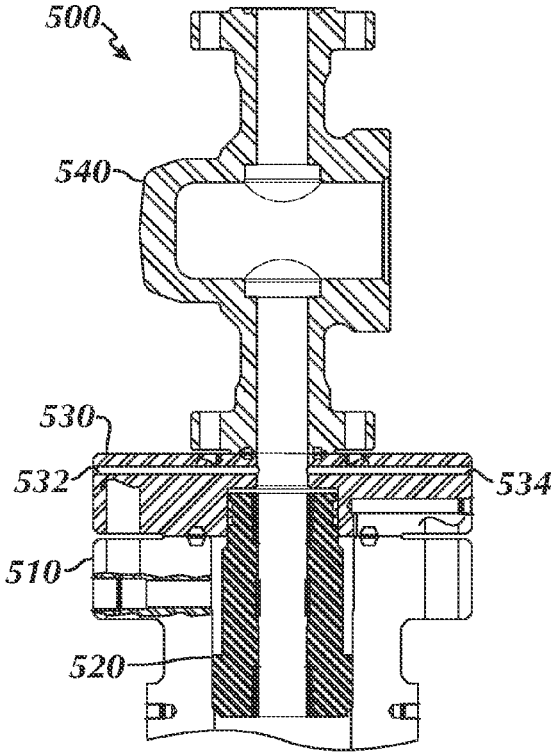
FIGS. 8A-8D illustrate cross-sectional views of a wellhead assembly in various stages of deploying the surface controlled safety valve of FIG. 6.

For example, FIGS. 8A-8D show a wellhead assembly 500 in various stages of deploying a surface controlled safety valve (not shown), such as valve 400 of FIG. 6. As shown in FIG. 8A, the assembly 500 includes an adapter 530 that bolts to the flange of a wellhead's hanger bowl 510 and that supports a spool, valve or one or more other such tree component 540 thereabove. A tubing hanger 520 positioned in the hanger bowl 510 seals with the adapter 530 and supports tubing (not shown) downhole. It is understood that the wellhead assembly 500 will have additional components that are not shown.

Initially, the surface controlled safety valve (400; FIG. 6) is installed downhole using capillary string procedures so that the valve seats in the downhole tubing according to the techniques discussed previously. The length of capillary string used to seat the valve can be measured for later use. After removing the capillary string and leaving the seated valve, operators may install a packer downhole as a secondary barrier. Then, operators drill and tap the adapter 530 with a control line port 532 and one or more retention ports 534 that communicate with the adapter's central bore. These ports 532 and 534 are offset from one another.

Figure 8B:
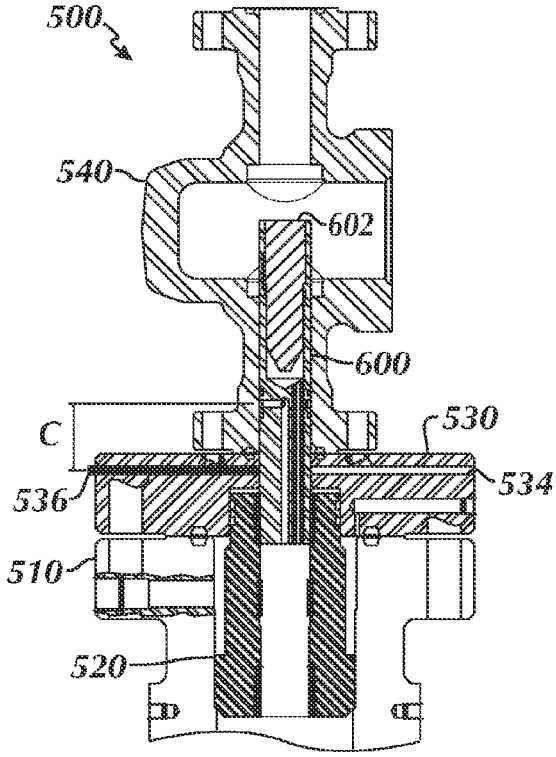
Figure 9A:
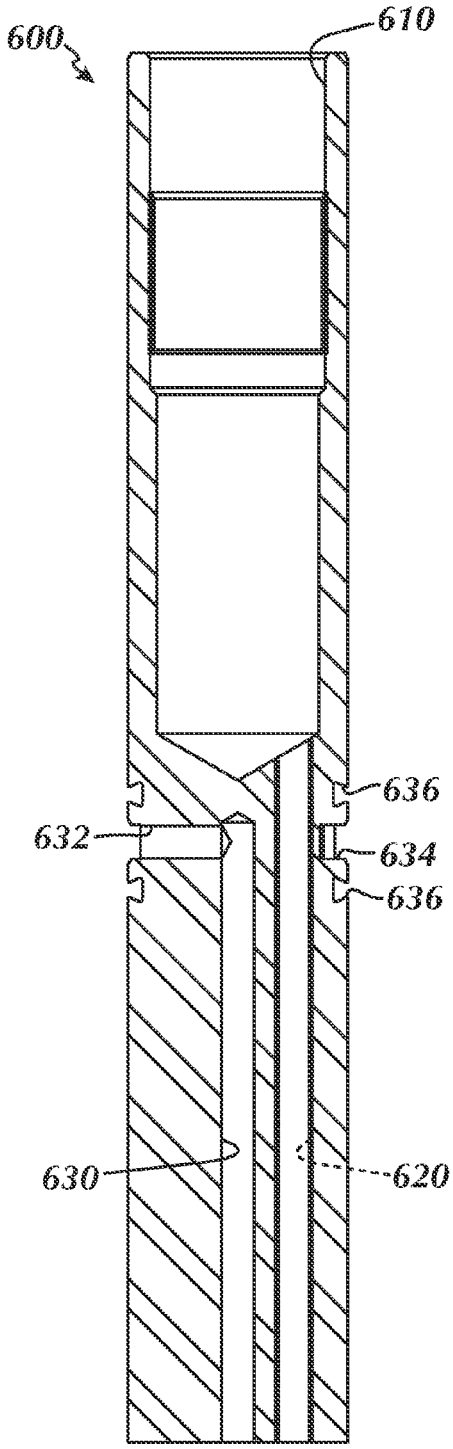
FIG. 9A is a detailed cross-section of a capillary hanger of the assembly of FIGS. 8A-8D.
Figure 9B:
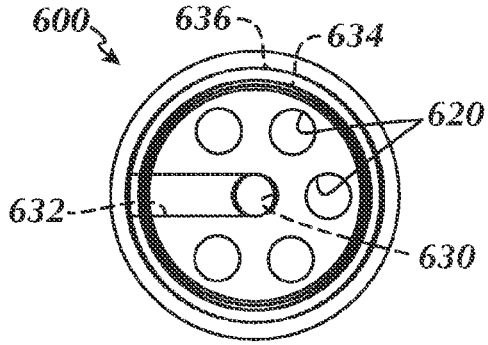
FIG. 9B is a top view of the capillary hanger of FIG. 9A.

As shown in FIG. 8B, operators then install a capillary hanger 600 through the tree component 540 using a seating element 602 that threads internally in the hanger 600. FIGS. 9A-9B show detailed views of the capillary hanger 600. Once installed, the hanger 600 seats on the tubing hanger 520, but the side port (632; FIG. 9A-9B) on the hanger 600 is offset a distance C from the control line port 532. Operators measure the point where the control line port 532 aligns with the hanger 600 and use this measurement to determine what length at the end of the hanger 600 must be cut off so that the hanger's side port (632; FIG. 9A) can align with the control line port 532.

Figure 8C:
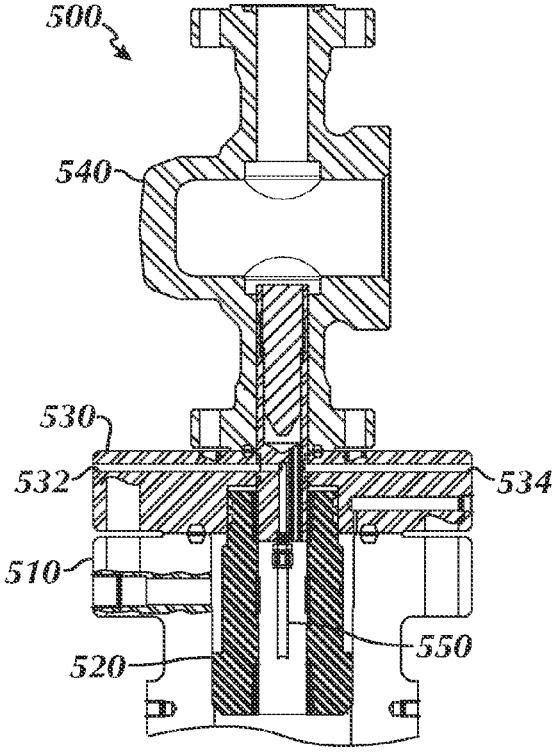

As shown in FIG. 8C, the excess on the end of the hanger 600 is removed, and operators secure a downhole control line 550 to the central control line port (630; FIGS. 9A-9B) on the hanger 600. Then, operators pass the control line 550 through the spool 540, adapter 530, tubing hanger 520, and head 510 and seat the capillary hanger 600 on the tubing hanger 520. With the hanger 600 seated, a quick connector (not shown) on the end of the control line 550 makes inside the safety valve (not shown) downhole according to the techniques described above. With the hanger 600 seated, upper and lower seals within the hanger's grooves (636; FIG. 9A) seal insides the adapter 530 above and below the ports 534 and 536 to seal the capillary hanger 600 in the assembly 500.

Figure 8D:
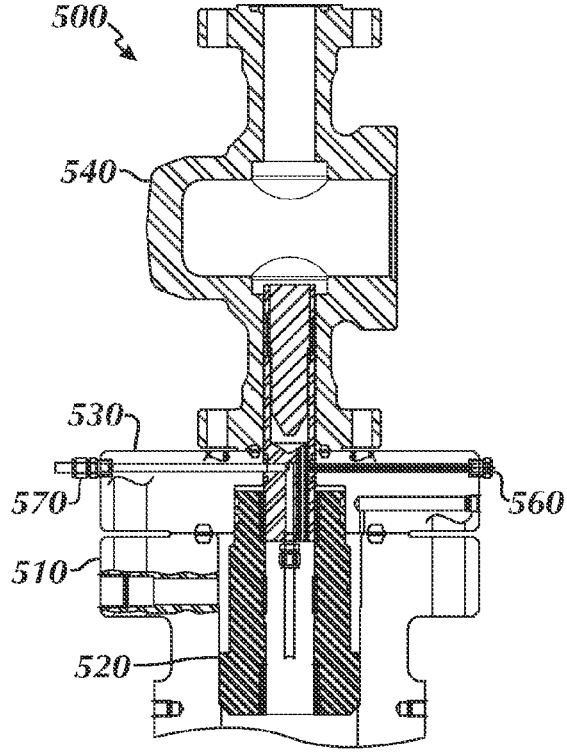

Finally, as shown in FIG. 8D, operators insert and lock one or more retention rods 560 in the one or more retention ports 534 so that they engage in the peripheral slot (634; FIGS. 9A-9B) around the hanger 600 to hold the hanger 600 in the adapter 530. With the hanger 600 secured, operators connect a fitting and control line 570 to the control line port 532 on the adapter 530 so the downhole safety valve can be hydraulically operated via the capillary string 550. Eventually, the seating element 600 can be removed from the capillary hanger 600 so that fluid can pass through axial passages (620; FIGS. 9A-9B) in the hanger 600.

Figure 10:
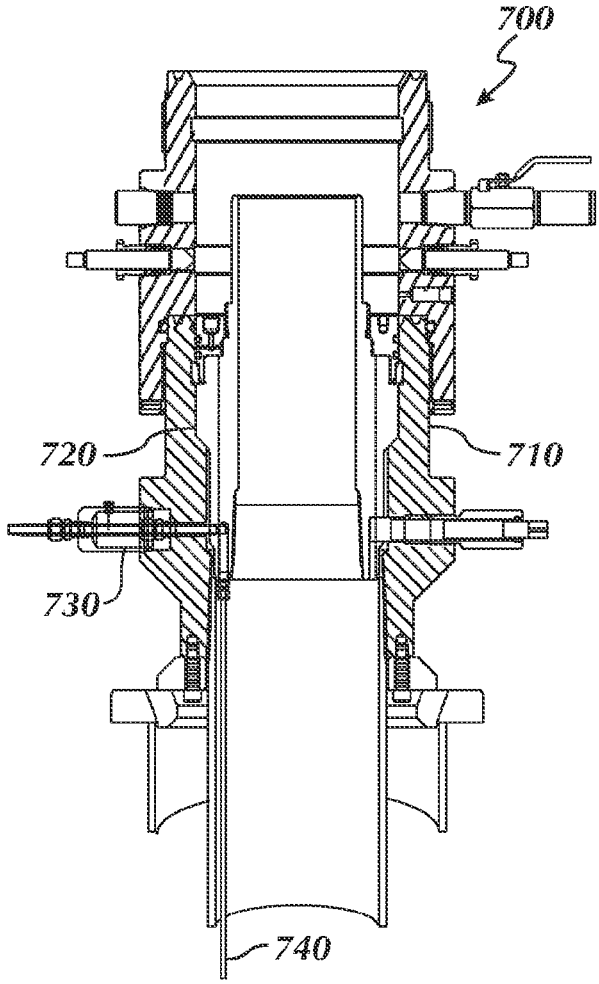
FIG. 10 shows another hanger and wellhead arrangement to deploy a capillary string for a downhole valve.

Another alternative for deploying the surface controlled safety valve (400; FIG. 6) can use one of the hanger and wellhead arrangements disclosed in U.S. application Ser. No. 11/925,498, which is incorporated herein by reference. As shown in FIG. 10, for example, a wellhead arrangement 700 has a hanger bowl 710 and tubing hanger 720. A capillary string 740 connects to the downhole valve (not shown) and to the bottom end of the tubing hanger 720. Fluid communication with the string 740 is achieved by drilling and tapping a connection 730 in the hanger bowl 710 that communicates with a side port in the tubing hanger 720.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A safety valve apparatus, comprising:

a housing defining a bore and having a projection disposed in the bore, the projection having a port with a first end communicating with the bore;

at least one locking dog disposed on the housing and movable relative to the housing between engaged and disengaged positions, the at least one locking dog in the engaged position engagable with an inner conduit wall surrounding the housing;

a flapper rotatably disposed on the housing and movable relative to the bore between opened and closed positions;

a first sleeve disposed within the bore above the projection and being mechanically movable between first and second locked positions, the first sleeve in the first locked position moving the at least one locking dog to the engaged position, the first sleeve in the second locked position permitting the at least one locking dog to move to the disengaged position;

a piston disposed in the housing and hydraulically communicating with the port; and a second sleeve disposed within the bore below the projection, the second sleeve coupled to the piston, the piston disposed in a first annular space between the second sleeve and the housing, the second sleeve concealing the piston in the first annular space and being hydraulically movable between first and second positions via hydraulic communication of the port with the piston, the second sleeve in the first position moving the flapper to the opened position, the second sleeve in the second position permitting the flapper to move to the closed position.

2. The apparatus of claim 1, further comprising a male member of a hydraulic connector disposed in the bore of the housing and connected to the first end of the port.

3. The apparatus of claim 2, further comprising a female member of the hydraulic connector connecting to a capillary string, the female member disposable in the bore and mateable with the male member.

4. The apparatus of claim 1, wherein the housing comprises an intermediate body having the projection and disposed in the bore of the housing, the port in the projection having a second end communicating with a second annular space between the housing and the intermediate body.

5. The apparatus of claim 4, wherein the second annular space hydraulically communicates with the piston disposed in the first annular space.

6. The apparatus of claim 1, further comprising a spring disposed about the first sleeve and between the first sleeve and the housing, the spring biasing the first sleeve to the first locked position.

7. The apparatus of claim 1, further comprising a spring disposed about the second sleeve and between the second sleeve and the housing, the spring biasing the second sleeve to the second position.

8. The apparatus of claim 1, wherein a distal end of the first sleeve is movable relative to the at least one locking dog and moves the at least one locking dog to the engaged position.

9. The apparatus of claim 1, further comprising at least one trigger dog disposed on the first sleeve, the at least one trigger dog engagable with a first inner groove of the bore when the first sleeve is in the first locked position and engagable with a second inner groove of the bore when the first sleeve is in the second locked position.

10. The apparatus of claim 1, wherein the flapper is rotatable on a pin disposed on the housing and is biased to the closed position by a torsion spring disposed on the pin.

11. A method of deploying a retrievable safety valve in a well, comprising:

deploying a retrievable safety valve in a landing nipple downhole in the well with a wireline tool;

engaging locking dogs on the retrievable safety valve within the landing nipple using the wireline tool;

conveying the capillary string downhole to the retrievable safety valve;

connecting a quick connector on a distal end of the capillary string to the retrievable safety valve;

communicating hydraulic fluid to the retrievable safety valve via the capillary string;

moving a sleeve within the retrievable safety valve by actuating a concealed piston with the communicated hydraulic fluid, the concealed piston coupled to the sleeve and disposed within an annular space in the retrievable safety valve, the sleeve concealing the piston in the annular space; and opening a biased flapper on the retrievable safety valve with the movement of the sleeve.

12. The method of claim 11, wherein conveying the capillary string comprises:

tapping a first cross port in a wellhead;

attaching the capillary string to a capillary hanger;

conveying the capillary string through the wellhead;

landing the capillary hanger in the wellhead; and aligning a side port on the capillary hanger with the first cross port, the side port communicating with the capillary string.

13. The method of claim 12, wherein conveying the capillary string comprises:

tapping a second cross port in the wellhead;

installing a retention rod through the second cross port after landing the capillary hanger in the wellhead, and engaging an end of the retention rod in an external pocket on the capillary hanger.

14. The method of claim 12, wherein landing the capillary hanger in the wellhead comprises engaging seals on the capillary hanger above and below the side port with an inside bore of the wellhead.

15. The method of claim 12, wherein before attaching the capillary string to the capillary hanger, the method comprises:

landing the capillary hanger in the wellhead without the capillary string;

determining a length on an end of the capillary hanger to remove to align the side port on the capillary hanger with the first cross port;

removing the capillary hanger; and removing the length from the end of the capillary hanger.

16. The method of claim 12, wherein communicating hydraulic fluid to the retrievable safety valve via the capillary string comprises attaching a control line outside the wellhead to the first cross port, the control line communicating with the capillary string via the first cross port at the wellhead and the side port in the capillary hanger.

17. The method of claim 11, wherein communicating hydraulic fluid to the retrievable safety valve via the capillary string comprises conveying the hydraulic fluid to a single port on the retrievable safety valve having the quick connector, the single port communicating with an annular space, the annular space disposed within the retrievable safety valve and communicating with the concealed piston.

18. The method of claim 11, further comprising:

disconnecting the quick connector on the distal end of the capillary string from the retrievable safety valve; and retrieving the retrievable safety valve from the well using the wireline tool.

19. The method of claim 11, wherein the capillary hanger defines an external pocket thereabout, the side port communicating with the external pocket, and wherein landing the capillary hanger in the wellhead comprises at least aligning the external pocket with the first cross port.

20. A safety valve apparatus, comprising:

a housing defining a bore and having a projection disposed in the bore, the projection having a port with a first end communicating with the bore;

at least one locking dog disposed on the housing and movable relative to the housing between engaged and disengaged positions, the at least one locking dog in the engaged position engagable with an inner conduit wall surrounding the housing;

a flapper rotatably disposed on the housing and movable relative to the bore between opened and closed positions;

a first sleeve disposed within the bore above the projection and being mechanically movable between first and second locked positions, the first sleeve in the first locked position moving the at least one locking dog to the engaged position, the first sleeve in the second locked position permitting the at least one locking dog to move to the disengaged position;

at least one trigger dog disposed on the first sleeve, the at least one trigger dog engagable with a first inner groove of the bore when the first sleeve is in the first locked position and engagable with a second inner groove of the bore when the first sleeve is in the second locked position;

a piston disposed in the housing and hydraulically communicating with the port; and a second sleeve disposed within the bore below the projection, the second sleeve coupled to and concealing the piston and being hydraulically movable between first and second positions via hydraulic communication of the port with the piston, the second sleeve in the first position moving the flapper to the opened position, the second sleeve in the second position permitting the flapper to move to the closed position.

21. The apparatus of claim 20, further comprising a male member of a hydraulic connector disposed in the bore of the housing and connected to the first end of the port.

22. The apparatus of claim 21, further comprising a female member of the hydraulic connector connecting to a capillary string, the female member disposable in the bore and mateable with the male member.

23. The apparatus of claim 20, wherein the housing comprises an intermediate body having the projection and disposed in the bore of the housing, the port in the projection having a second end communicating with an annular space between the housing and the intermediate body.

24. The apparatus of claim 23, wherein the annular space hydraulically communicates with the piston coupled to the second sleeve.

25. The apparatus of claim 20, further comprising a spring disposed about the first sleeve and between the first sleeve and the housing, the spring biasing the first sleeve to the first locked position.

26. The apparatus of claim 20, further comprising a spring disposed about the second sleeve and between the second sleeve and the housing, the spring biasing the second sleeve to the second position.

27. The apparatus of claim 20, wherein a distal end of the first sleeve is movable relative to the at least one locking dog and moves the at least one locking dog to the engaged position.

28. The apparatus of claim 20, wherein the flapper is rotatable on a pin disposed on the housing and is biased to the closed position by a torsion spring disposed on the pin.

29. A method of deploying a retrievable safety valve in a well, comprising:

deploying a retrievable safety valve in a landing nipple downhole in the well with a wireline tool;

engaging locking dogs on the retrievable safety valve within the landing nipple using the wireline tool;

tapping a first cross port in a wellhead of the well;

landing a capillary hanger in the wellhead, the capillary hanger having a side port;

determining a length on an end of the capillary hanger to remove to align the side port with the first cross port;

removing the length from the end of the capillary hanger;

attaching a capillary string to the capillary hanger;

conveying the capillary string downhole to the retrievable safety valve;

landing the capillary hanger in the wellhead with the first cross port communicating with the side port and the capillary string; and connecting a quick connector disposed on a distal end of the capillary string to the retrievable safety valve.

30. The method of claim 29, wherein tapping the first cross port comprises tapping a second cross port in the wellhead; and wherein landing the capillary hanger in the wellhead comprises:

installing a retention rod through the second cross port, and engaging an end of the retention rod in an external pocket on the capillary hanger.

31. The method of claim 29, wherein landing the capillary hanger in the wellhead comprises engaging seals on the capillary hanger above and below the side port with an inside bore of the wellhead.

32. The method of claim 29, wherein the capillary hanger defines an external pocket thereabout, the side port communicating with the external pocket, and wherein landing the capillary hanger in the wellhead comprises at least aligning the external pocket with the first cross port.

33. The method of claim 29, further comprising:

communicating hydraulic fluid to the retrievable safety valve via the capillary string;

moving a sleeve within the retrievable safety valve by actuating a concealed piston with the communicated hydraulic fluid, the concealed piston coupled to the sleeve and concealed within the retrievable safety valve by the sleeve; and opening a biased flapper on the retrievable safety valve with the movement of the sleeve.

34. The method of claim 33, wherein communicating hydraulic fluid to the retrievable safety valve via the capillary string comprises attaching a control line outside the wellhead to the first cross port, the control line communicating with the capillary string via the first cross port at the wellhead and the side port in the capillary hanger.

35. The method of claim 33, wherein communicating hydraulic fluid to the retrievable safety valve via the capillary string comprises conveying the hydraulic fluid to a single port on the retrievable safety valve having the quick connector, the single port communicating with an annular space, the annular space disposed within the retrievable safety valve and communicating with the concealed piston.

36. The method of claim 29, further comprising:

disconnecting the quick connector from the retrievable safety valve; and retrieving the retrievable safety valve from the well using the wireline tool.

* * * * *